US008206091B2

(12) United States Patent
Nakamura et al.

(10) Patent No.: US 8,206,091 B2
(45) Date of Patent: Jun. 26, 2012

(54) EXHAUST GUIDE MEMBER OF NOZZLE VANE-TYPE TURBOCHARGER

(75) Inventors: Sadayuki Nakamura, Shunan (JP); Manabu Oku, Shunan (JP); Yoshiaki Hori, Shunan (JP)

(73) Assignee: Nisshin Steel Co., Ltd., Tokyo (JP)

( * ) Notice: Subject to any disclaimer, the term of this patent is extended or adjusted under 35 U.S.C. 154(b) by 209 days.

(21) Appl. No.: 12/227,938

(22) PCT Filed: Apr. 18, 2008

(86) PCT No.: PCT/JP2008/058002

§ 371 (c)(1), (2), (4) Date: Dec. 3, 2008

(87) PCT Pub. No.: WO2008/133320

PCT Pub. Date: Nov. 6, 2008

(65) Prior Publication Data

US 2010/0068040 A1 Mar. 18, 2010

(30) Foreign Application Priority Data

Apr. 19, 2007 (JP) ..... 2007-110139

(51) Int. Cl.
*F04D 29/56* (2006.01)

(52) U.S. Cl. ..... 415/160; 415/200

(58) Field of Classification Search ..... 415/160
See application file for complete search history.

(56) References Cited

U.S. PATENT DOCUMENTS 4,530,720 A * 7/1985 Moroishi et al. ..... 420/43
4,804,316 A * 2/1989 Fleury ..... 417/407

FOREIGN PATENT DOCUMENTS

| | | |
|---|---|---|
| JP | 54-56018 | 5/1979 |
| JP | 6-10114 | 1/1994 |
| JP | 8-239737 | 9/1996 |
| JP | 2002-332857 | 11/2002 |
| JP | 2002-332862 | 11/2002 |

* cited by examiner

*Primary Examiner* — Stephen W Smoot
(74) *Attorney, Agent, or Firm* — Clark & Brody

(57) ABSTRACT

In a turbocharger equipped with a nozzle vane for changing the speed of exhaust gas running through a turbine in accordance with the speed of engine revolution, the member to constitute the nozzle vane and to constitute an exhaust guide for guiding exhaust gas to the turbine is characterized in that the exhaust guide member of a nozzle vane-type turbocharge is formed of an austenite stainless steel containing, in terms of % by mass, at most 0.08% of C, from 2.0 to 4.0% of Si, at most 2.0% of Mn, from 8.0 to 16.0% of Ni, from 18.0 to 20.0% of Cr and at most 0.04% of N and containing these ingredients in such a manner that they satisfy a DE value of the specified formula to be from 5.0 to 12.0, with a balance of Fe and inevitable impurities.

16 Claims, 1 Drawing Sheet

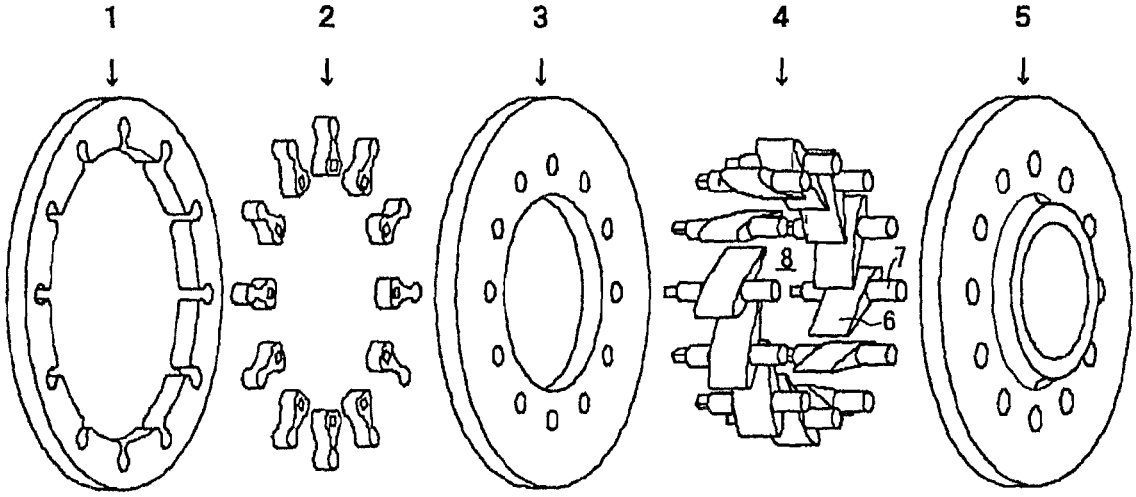
1
2
3
4
5
8
7
6

EXHAUST GUIDE MEMBER OF NOZZLE VANE-TYPE TURBOCHARGER

TECHNICAL FIELD

The present invention relates to an exhaust guide member to constitute the nozzle vane of a turbocharger equipped with a nozzle vane, which is to change the speed of exhaust gas running through a turbine in accordance with the speed of engine revolution, and the member constitutes an exhaust guide for guiding exhaust gas to the turbine.

BACKGROUND ART

As a turbocharger, well known are a wastegate-type one and a nozzle vane-type one. The wastegate-type turbocharger is mainly for improving engine power; but the nozzle vane-type turbocharger contributes not only toward power improvement but also toward exhaust gas clarification, and recently, in particular, it has become mounted also on diesel engines. The member that constitutes the latter nozzle vane and constitutes an exhaust guide for guiding exhaust gas to a turbine is manufactured mainly by the use of a stainless steel plate, for example, a heat-resistant steel plate of SUS310S or the like. As a special case, Patent Reference 1 describes an invention of manufacturing such an exhaust guide assembly with a high-chromium high-nickel material through precision casting and machining.

FIG. 1 shows an exploded view of one embodiment of members that constitute an exhaust guide of a nozzle vane-type turbocharger. These are a drive ring 1, a drive lever 2, an intermediate nozzle ring 3, a nozzle vane 4 and an outer nozzle ring 5; and the nozzle vane 4 comprises plural vanes 6 to constitute it and vane shafts 7 to support the respective vanes 6. These members 1 to 5 are concentrically assembled and set on the upstream side of the turbine of a turbocharger; and the assembly forms an exhaust guide that guides an exhaust gas to the turbine of a turbocharger through the center opening 8 of the nozzle vane 4. The shafts 7 of the respective vanes 6 of the nozzle vane 4 rotate all in the same direction; and in accordance with the degree of the rotation, the open area (aperture) of the center opening 8 surrounded by the vanes 6 is increased and decreased. When the speed of engine revolution is low, then the displacement is low and the exhaust pressure is low, and in that condition, the open area of the center opening 8 is narrow; but when the speed of engine revolution is increased and the displacement is thereby increased, then the member is driven to broaden the open area. Accordingly, the case having such a nozzle vane is so driven that the speed of the exhaust gas to be led into a turbine is varied in accordance with the speed of engine revolution, or that is, the exhaust gas speed is increased when the speed of engine revolution is low but is lowered when it is high, as compared with a case not having the nozzle vane.

The necessary material characteristics of these members individually differ as follows:

[Drive Ring 1 and Drive Lever 2]

These members are for accurately controlling the aperture of the nozzle vane, working with an actuator; and in general, these are manufactured by blanking with a press, and are required to satisfy fine blanking capability (precision blanking workability) such that the blanked faces could be all shear faces. In their service environment, in addition, the temperature may increase up to about 500° C., and therefore their high-temperature strength in a middle temperature range is important.

[Intermediate Nozzle Ring 3 and Outer Nozzle Ring 5]

These both have location holes for smoothly rotating the vane shafts 7. The outer nozzle ring 5 has a part of ring forging (burring) into a shape that corresponds to the shape of a turbine, in the center opening. Accordingly, these are required to have good machinability and press-formability. These are members serving also for guiding exhaust gas, and are therefore required to keep good high-temperature strength and oxidation resistance even though exposed to high temperatures of about 800° C.

[Nozzle Vane 4]

The nozzle vane 4 is for controlling the open area of an exhaust gas route. Therefore, this is all the time exposed to the exhaust gas running through it, and is exposed to the highest temperature (800 to 900° C.) among the members. Accordingly, this is required to have high-temperature strength enough to resist the pulsating pressure of exhaust gas and to have high-temperature oxidation resistance for smooth driving even at high temperatures. Because of those necessary characteristics, heat-resistant steel plates of SUS310S or the like are generally used for it, but SUS310S steel plates have poor workability.

As in the above, the necessary material characteristics of exhaust guide members of nozzle vane-type turbochargers individually differ for the respective members, and therefore, in general, different steel materials are used for the individual members and different processes are employed individually for them. However, when the members formed of different materials are assembled into a nozzle vane-having exhaust guide assembly, then the difference in the thermal expansion coefficient between the members and the difference in the degree of the formed oxidation scale therebetween may interfere with smooth aperture control of the open area in the exhaust gas route that is the intrinsic function of the nozzle vane-type turbocharger. This problem could be solved when all the exhaust guide members are formed of the same material (steel of the same type); however, a material capable of simultaneously and sufficiently satisfying the above-mentioned, individually different characteristics is unknown. Accordingly, at present, the respective members are formed of different materials that individually satisfy the respective necessary characteristics.

Patent Reference 1 describes an invention for manufacturing an exhaust guide assembly of turbocharger according to a lost wax casting method of using a special high-chromium high-nickel heat-resistant steel that contains Pb, Se and Te. In the invention, the main machining comprises cutting and polishing, and therefore, steel shaping may be omitted and the problem of shapability necessary for steel may be evaded therein. However, the steel contains special additive elements and precision casting is employed for it, and therefore this requires a special manufacture process inevitably with poor producibility and cost increase, as compared with a case of manufacturing exhaust guides in an ordinary production line. In case where a steel plate of SUS310S is used for a member required to have high-temperature oxidation resistance to a further higher level, surface treatment of steel chromizing (treatment for diffusing and penetrating chromium into the surface of steel) or the like may be effective, but this is problematic in that the production process is inevitably complicated and its cost must increase. The chromizing treatment is described in Patent Reference 2.

Patent Reference 1: JP-A 2002-332862

Patent Reference 2: JP-A 6-10114

PROBLEMS THAT THE INVENTION IS TO SOLVE

An object of the present invention is to solve the above-mentioned problems and to make it possible to produce an exhaust guide member of turbocharger having good high-temperature oxidation resistance and high-temperature strength from a stainless steel plate of the same type with good producibility, therefore providing an exhaust guide member inexpensive and excellent in durability.

MEANS FOR SOLVING THE PROBLEMS

According to the present invention, there is provided an exhaust guide member of a nozzle vane-type turbocharger equipped with a nozzle vane for changing the speed of exhaust gas running through a turbine in accordance with the speed of engine revolution, wherein the member to constitute the nozzle vane and to constitute an exhaust guide for guiding exhaust gas to the turbine is formed of an austenite stainless steel containing, in terms of % by mass, at most 0.08% of C, from 2.0 to 4.0% of Si, at most 2.0% of Mn, from 8.0 to 16.0% of Ni, from 18.0 to 20.0% of Cr and at most 0.04% of N and containing these ingredients in such a manner that they satisfy a DE value of the following formula (in the formula, the element code indicates the content (% by mass) of the ingredient in the steel) to be from 5.0 to 12.0:

$$\text{DE value}=\text{Cr}+1.5\text{Si}+0.5\text{Nb}+\text{Mo}—\text{Ni}-0.3\text{Cu}-0.5\text{Mn}-30(\text{C}+\text{N}),$$

with a balance of Fe and inevitable impurities.

The austenite stainless steel may contain one or two of Nb and Ti in a total amount of from 0.05 to 1.0% by mass, one or two of Mo and Cu in a total amount of from 0.50 to 5.0% by mass, and one or two of REM (rare earth element including Y) and Ca in a total amount of from 0.01 to 0.20% by mass. The exhaust guide member according to the invention may be at least one of the drive ring, the drive lever, the nozzle ring, and the vane and its shaft of the nozzle vane illustrated in FIG. 1.

The exhaust guide member of a nozzle vane-type turbocharger of the invention may be produced not requiring any special production method and treatment, and its high-temperature oxidation resistance is good, and its high-temperature strength and high-temperature slidability (high-temperature abrasion resistance) are also good.

BRIEF DESCRIPTION OF THE DRAWING

FIG. 1 is an exploded view showing an exhaust guide of a turbocharger, as exploded into the members constituting it.

PREFERRED EMBODIMENTS OF THE INVENTION

The exhaust guide member of a nozzle vane-type turbocharger is required to have the above-mentioned characteristics; and in short, the part to be in contact with exhaust gas is required to have heat resisting properties such as high-temperature strength and respective members are required to have the following individual characteristics in accordance with their functions.

The nozzle ring must have suitable work-hardening characteristics for keeping the necessary hole-expanding workability. The vanes of the nozzle vane must have excellent ductility as they are cold-forged to have a wing-like shape. The drive ring and the drive lever must have good slidability at high temperatures.

In case where stainless steel is applied to such various requirements, a meta-stable austenite stainless steel such as typically SUS304 may form work-induced martensite in the worked face, when worked by blanking; and when it is thereafter worked by hole-expanding or the like, then it may be often cracked starting from the blanked edge thereof. Accordingly, its workability (burring capability) after blanking is poor. On the other hand, a stable austenite such as typically SUS310S does not form work-induced martensite during transformation, and therefore, as compared with the above-mentioned meta-stable austenite steel, its burring capability is excellent but its uniform elongation is poor. Accordingly, it could not have excellent hole-expanding capability. The same tendency is also seen in point of the cold-forging capability necessary for the nozzle vane; and the above-mentioned type of steel that produces significant work-induced martensite and the type of steel poor in uniform elongation are unsuitable to nozzle vane production as they are poor in plastic flowability.

The present inventors have made various tests and investigations for solving these problems. As a result, first, it has been found that, when Si is added to a stable austenite stainless steel in an amount of from 2.0 to 4.0% by mass, then the softness of the material may be kept as such and the material may have suitable work-hardening characteristics, and further, its elongation may increase and its hole-expanding efficiency may also increase, and therefore it is suitable to production of exhaust guide members. The main reason is that addition of a suitable amount of Si may lower stacking fault energy and therefore the work-hardening index of the stable austenite stainless steel may also increase. Further, it has been found that the Si addition may improve the slidability at high temperatures of drive rings and drive levers. This is because the Si-added steel produces little oxidation scale at high temperatures, and even though produced, the scale has excellent peeling resistance therefore causing little scale peeling and abrasion by sliding, and the steel may keep excellent high-temperature slidability.

Further, it has been found that addition of Nb, Ti, Mo, Cu, REM and Ca to the stainless steel of the type could improve the high-temperature strength and the high-temperature oxidation resistance of the steel, but they must be added suitably with correlation to Si addition thereto. Specifically, Si addition to a stable austenite could promote the formation of a δ-ferrite phase in a high-temperature range; however, suitable formation of a δ-ferrite phase could improve hot workability but excess formation thereof rather lowers hot workability, therefore often causing edge breakage or the like, and the producibility is thereby greatly lowered. It has been found that this problem based on Si addition can be solved by incorporating these elements to steel in such a manner that the DE value of the following formula may fall within a range of from 5.0 to 12.0, and the steel can thereby keep good hot workability. In the formula, the element code indicates the content (% by mass) of the ingredient in the steel.

$$\text{DE value}=\text{Cr}+1.5\text{Si}+0.5\text{Nb}+\text{Mo}—\text{Ni}-0.3\text{Cu}-0.5\text{Mn}-30(\text{C}+\text{N}).$$

The present invention has been made on the basis of these findings, and it has made it possible to produce an exhaust guide member of a turbocharger having good high-temperature oxidation resistance and high-temperature strength from a steel of the same type with good producibility so as to satisfy at the same time the material characteristics necessary for the individual members. The present invention is characterized in that it has clarified the constitutive ingredient composition of steel having the property applicable to all of exhaust guide members. The summary of the reasons for the definition of the content of each constitutive ingredient of steel is described below.

C is an austenite-forming element, and increases the high-temperature strength of steel. However, in the service environment of exhaust guide members of a nozzle vane-type turbocharger, when C is over 0.08% by mass, then a carbide may be often formed in a high-temperature range in the environment; and when a carbide is formed, the high-temperature strength of the steel may lower. Accordingly, the C amount is at most 0.08% by mass, preferably at most 0.06% by mass.

Si is a steel ingredient that plays an important role in the invention, as so mentioned in the above; and addition of Si to steel improves the hole-expanding capability and the high-temperature oxidation resistance of steel. For this, addition of at least 2.0% by mass is necessary; however, excessive addition may detract from the stability of austenite phase and may rather worsen the workability of steel. Accordingly, the Si amount is from 2.0 to 4.0% by mass.

When Mn is added to steel in an amount of more than 2.0% by mass, then the amount of oxidation scale to form in a high-temperature range in the service environment of exhaust guide members may increase and the function of the members may be thereby worsened. Accordingly, the Mn content is at most 2.0% by mass.

Ni is an element that stabilizes an austenite phase; and accordingly, it is incorporated in an amount of at least 8.0% by mass. However, it is expensive and when added too much, it may lower the δ-ferrite amount that is necessary in some degree; and therefore, the Ni amount is from 8.0 to 16.0% by mass.

Cr stabilizes the oxidation resistance at high temperatures, and must be incorporated in an amount of at least 18.0% by mass. However, when added too much, then it may detract from the producibility and may excessively increase the δ-ferrite amount. Accordingly, the Cr amount is from 18.0 to 20.0% by mass.

Ti and Nb both fix C and N in steel as carbonitrides, and the carbonitrides finely disperse and precipitate in steel to thereby increase the high-temperature strength of steel; however, when Ti and Nb are added excessively, then they may detract from the hot workability and the surface quality characteristics of steel. Accordingly, one or two of these elements are incorporated preferably in an amount of from 0.05 to 1.0% by mass in total.

Mo and Cu improve the high-temperature strength and the oxidation resistance in high-temperature wet condition of steel; however, excessive addition thereof may detract from the hot workability of steel. Accordingly, one or two of Mo and Cu are incorporated preferably in an amount of from 0.50 to 5.0% by mass in total.

REM (rare earth element including Y) and Ca have an effect of inhibiting intergranular oxidation at high temperatures and thereby improving the peeling resistance of oxidation scale; however, too much addition thereof may detract from the hot workability of steel. Accordingly, one or two of REM and Ca are incorporated preferably in an amount of from 0.01 to 0.20% by mass in total.

Incorporated in the amount as above, the ingredients of the steel in the invention are so controlled that they satisfy the DE value of the above-mentioned formula to fall from 5.0 to 12.0. Having the thus-controlled DE value to fall within the above range, the steel may keep good hot workability even though Si is added thereto. In general, when a stable austenite steel forms an austenite single phase at a heating temperature in hot rolling, then its high-temperature transformability may lower and there may occur edge breakage during hot rolling and the producibility is thereby lowered. To evade this, ingredient control is effective for forming a small amount of a δ-ferrite phase at a hot-rolling temperature. In this case, however, too small formation of δ-ferrite phase, and, on the contrary, too much formation thereof may worsen the hot workability of steel. The present inventors have found that, when the DE value is from 5.0 to 12.0, then the steel in the invention that has a tendency of promoting δ-ferrite phase formation by Si addition thereto may keep good hot workability, as shown in Examples given hereinunder. Specifically, one characteristic feature of the invention is that suitable Si addition and suitable DE value range selection can make it possible to produce a steel having the necessary severe characteristics all at a time for exhaust guide members with good producibility.

EXAMPLES

Table 1 shows the data of the chemical ingredients and the DE value of steel samples prepared herein. These were produced by vacuum melting of 30 kg of steel; and the produced steel ingots were all forged into ϕ 15 mm columnar rods and plates having a thickness of 30 mm. The obtained columnar rods were processed for solution treatment at 1100° C. The obtained forged plates were hot-rolled into plates having a thickness of 4 mm; and two types of test steel plates were formed of those hot-rolled plates. One of the hot-rolled plates was annealed and then cold-rolled to a thickness of 1.5 mm, and finally annealed to be a cold-rolled annealed plate. The hot-rolling condition and the annealing condition were as follows: The hot-rolling temperature was 1200° C.; the annealing of the hot-rolled plate was at 1100° C.×soaking for 60 seconds; and the final annealing was at 1100° C.×soaking for 30 seconds. The other hot-rolled plate was annealed under the same condition as above, and then its surface was cut to a thickness of 3 mm, thereby preparing a hot-rolled cut plate having a thickness of 3 mm.

From these "columnar rods", "cold-rolled annealed plates" and "hot-rolled cut plates", predetermined test pieces were formed, and tested in the following tests.

(1) The columnar rods were tested in a high-temperature tensile test. Briefly, the columnar rod was worked into a test piece having a diameter in the parallel part of 10 mm, and this was tested in a high-speed tensile test at 1000° C. and at a strain speed of 10/s, and in a high-temperature tensile test at 800° C. according to JISG056. In the former high-speed tensile test, the hot workability of the sample was evaluated by [(area of the cross section of the sample before the test−area of the cross section of the sample after the test)/(area of the cross section of the sample before the test)] (this is the cross section area reduction ratio under hot tension). The sample having a smaller cross section area reduction ratio under hot tension has better hot workability. In the latter high-temperature tensile test, the tensile strength at the test temperature indicates the high-temperature strength of the tested sample.

(2) The cold-rolled annealed plate was tested in a hole-expanding test toward a blanked hole and in a high-temperature oxidation resistance test. Briefly, a test piece of 90 mm square was prepared from the cold-rolled annealed plate, and the test piece was blanked to form a hole having a diameter of 10 mm at the center thereof. This was tested in a hole-expanding test in which a conical punch having an opening angle of 300° was inserted into the blanked hole under a wrinkle pressing pressure of 44 kN. At the time when the tip edge of the hole-expanded part was cracked at room temperature, the punch insertion was stopped, and the hole diameter was measured. The ratio of [(hole diameter Dx after the test−hole diameter $D_0$ before the test)/(hole diameter $D_0$ before the test)] indicates the hole expanding capability (burring workability) after blanking of the tested sample. The sample having a higher hole-expanding ratio has a more excellent hole-expanding capability after blanking.

The entire surface of the cold-rolled annealed plate was polished with a #400 abrasive. This was processed repeatedly according to a cycle of "heating at 900° C. for 25 minutes in an air atmosphere controlled to have a dew point of +60° C. with water vapor addition" followed by "cooling in the atmosphere at room temperature for 10 minutes", for a total of 1000 cycles. The value computed by dividing the mass change before and after the test by the surface area indicates the high-temperature oxidation resistance of the tested sample. The sample having a smaller absolute value of the found data has more excellent high-temperature oxidation resistance. In other words, the larger negative value means the increase in the oxidation amount; and the larger positive value means the occurrence of a phenomenon of oxidation scale peeling.

(3) The hot-rolled cut plate was tested in a high-temperature slide test. Briefly, a base plate of 10 mm×20 mm was cut out of the hot-rolled cut plate having a thickness of 3 mm, and its surface was polished with a #1000 abrasive. A slide plate of 10 mm (short side)×11 mm (long side) was cut out of the same hot-rolled cut plate having a thickness of 3 mm, and one short side thereof was tapered. The tapering was as follows: The side of the plate was cut in such a manner that the center of the plate thickness could protrude outside to give a protruding edge (the cross section could have a convexly curved face with R=1.5 mm), and its surface was polished with a #1000 abrasive. The tapered side of the slide plate was kept in contact with the base plate. Concretely, on the center of the base plate put horizontally, the slide plate was put vertically in such a manner that its tapered side could slide on the base plate. The test was as follows: Both plates were soaked at 800° C. for 1 hour, and then, at that temperature with a load of 2 N applied in the vertical direction to the slide plate put on the base plate, the slide plate was slid for a total of 1000 back-and-forth strokes at a speed of 6 seconds/stroke for a distance of 10 mm as one stroke. After the test, the slide plate was checked as follows: The surface roughness of the slide part of the plate kept in linear contact with the base plate was measured with a probe-assisted surface roughness tester, and the roughness (Ra) indicates the high-temperature abrasion amount. The sample having a larger Ra value has poorer high-temperature slidability; and for example, the sample having Ra of more than 1.0 μm could not satisfy high-temperature slidability necessary for exhaust guide members.

The test results are shown in Table 2.

TABLE 1

Chemical Ingredients of Steel Samples (mass %)

| No. | C | Si | Mn | Ni | Cr | N | Nb | Ti | Mo | Cu | REM | Ca | DE Value |
|---|---|---|---|---|---|---|---|---|---|---|---|---|---|
| A1 | 0.031 | 3.52 | 0.75 | 13.54 | 18.92 | 0.020 | — | — | — | — | — | — | 8.8 |
| A2 | 0.040 | 3.30 | 0.81 | 13.05 | 18.75 | 0.021 | 0.11 | — | — | — | — | — | 8.5 |
| A3 | 0.025 | 2.95 | 0.71 | 12.87 | 18.15 | 0.025 | — | 0.31 | — | — | — | — | 7.9 |
| A4 | 0.052 | 2.85 | 0.85 | 9.30 | 18.09 | 0.024 | 0.13 | — | 0.85 | — | — | — | 11.3 |
| A5 | 0.045 | 3.85 | 1.55 | 15.64 | 18.04 | 0.018 | 0.08 | 0.15 | — | — | — | — | 5.6 |
| A6 | 0.025 | 2.25 | 0.79 | 10.52 | 19.54 | 0.024 | 0.35 | — | — | 1.62 | — | — | 10.2 |
| A7 | 0.032 | 2.62 | 0.82 | 10.62 | 19.06 | 0.021 | 0.21 | — | — | — | 0.013 | — | 10.5 |
| A8 | 0.028 | 2.97 | 0.99 | 11.03 | 19.18 | 0.031 | 0.18 | — | — | — | — | 0.005 | 10.4 |
| A9 | 0.037 | 2.03 | 0.76 | 10.38 | 18.92 | 0.022 | 0.16 | — | 1.03 | 0.82 | — | — | 10.0 |
| A10 | 0.041 | 2.89 | 0.88 | 10.88 | 19.08 | 0.024 | 0.22 | — | — | — | 0.011 | 0.004 | 10.3 |
| B1 | 0.062 | 0.49 | 0.78 | 8.05 | 18.07 | 0.026 | — | — | — | — | — | — | 7.7 |
| B2 | 0.068 | 0.81 | 1.59 | 20.50 | 25.45 | 0.027 | — | — | — | — | — | — | 2.5 |
| B3 | 0.036 | 3.32 | 0.78 | 9.22 | 18.90 | 0.024 | — | — | — | — | — | — | 12.5 |
| B4 | 0.045 | 1.75 | 0.76 | 13.18 | 18.52 | 0.022 | 0.14 | — | — | — | — | — | 5.6 |
| B5 | 0.036 | 2.75 | 0.89 | 16.52 | 18.12 | 0.021 | 0.12 | — | — | — | — | — | 3.7 |

TABLE 2

Characteristics Data of Steel Samples

| No. | Cross Section Area Reduction Ratio under hot tension (1000° C.) | Hole Expanding Ratio at room temperature $(Dx - D_0)/D_0$ | High-Temperature Tensile Strength (800° C.) | Weight Change in repeated oxidation test (900° C.) | High-Temperature Abrasion Amount (800° C.) | |
|---|---|---|---|---|---|---|
| A1 | 73% | 2.42 | 162 N/mm$^2$ | −0.9 mg/cm$^2$ | 0.81 μm | Sample of the Invention |
| A2 | 71% | 2.37 | 170 N/mm$^2$ | 0.7 mg/cm$^2$ | 0.70 μm | |
| A3 | 72% | 2.45 | 165 N/mm$^2$ | −1.5 mg/cm$^2$ | 0.78 μm | |
| A4 | 73% | 2.49 | 189 N/mm$^2$ | 1.0 mg/cm$^2$ | 0.68 μm | |
| A5 | 63% | 2.35 | 192 N/mm$^2$ | 0.4 mg/cm$^2$ | 0.74 μm | |
| A6 | 68% | 2.46 | 178 N/mm$^2$ | 1.2 mg/cm$^2$ | 0.82 μm | |
| A7 | 66% | 2.45 | 179 N/mm$^2$ | 0.8 mg/cm$^2$ | 0.64 μm | |
| A8 | 68% | 2.61 | 181 N/mm$^2$ | 1.1 mg/cm$^2$ | 0.77 μm | |
| A9 | 64% | 2.47 | 206 N/mm$^2$ | 0.3 mg/cm$^2$ | 0.69 μm | |
| A10 | 67% | 2.49 | 177 N/mm$^2$ | 0.9 mg/cm$^2$ | 0.58 μm | |
| B1 | 69% | 0.52 | 124 N/mm$^2$ | −62.5 mg/cm$^2$ | 1.71 μm | Comparative Sample |
| B2 | 57% | 1.74 | 113 N/mm$^2$ | −2.7 mg/cm$^2$ | 1.22 μm | |
| B3 | 52% | 1.89 | 182 N/mm$^2$ | 4.5 mg/cm$^2$ | 0.89 μm | |
| B4 | 64% | 1.92 | 135 N/mm$^2$ | −5.4 mg/cm$^2$ | 1.58 μm | |
| B5 | 51% | 2.17 | 185 N/mm$^2$ | 0.8 mg/cm$^2$ | 0.87 μm | |

From the results in Table 2, it is known that the cross section area reduction ratio under hot tension and the hole expanding ratio at room temperature of B2 and B5 having a DE value of less than 5 and B3 having a DE value of more than 12 are both lower than the data of those having a DE value of from 5 to 12. Accordingly, even though the former plates are tried to produce exhaust guide members, they are unsuitable as their producibility and shapability are poor. The high-temperature tensile strength of B1, B2 and B4 having an Si content of less than 2.0% by mass is lower than that of the others having an Si content of from 2.0 to 4.0% by mass; and the high-temperature oxidation resistance of the former is poorer (the weight change in the repeated oxidation test is larger). Accordingly, even though these steel plates are tried to produce exhaust guide members, they could not have the necessary characteristics. As opposed to these, A1 to A10 having a DE value of from 5 to 12 all have a large cross section area reduction ratio under hot tension and a large hole expanding ratio at room temperature, though having an Si content of from 2.0 to 4.0% by mass, and their high-temperature tensile strength and high-temperature oxidation resistance are both good, and their high-temperature slidability is also good (their high-temperature abrasion amount is small). Accordingly, they satisfy all the material characteristics necessary for all the members constituting an exhaust guide, and their producibility and shapability are also good. Therefore, even when all the constitutive members are formed of the steel of the same type, an exhaust guide assembly capable of satisfying all the necessary characteristics can be produced.

The invention claimed is:

1. An exhaust guide member of a nozzle vane-type turbocharger equipped with at least a nozzle vane and drive ring for changing the speed of exhaust gas running through a turbine in accordance with the speed of engine revolution, wherein the member to constitute the nozzle vane and the drive ring and to constitute an exhaust guide for guiding exhaust gas to the turbine is formed of an austenite stainless steel consisting of, in terms of % by mass, at most 0.08% of C, from 2.0 to 4.0% of Si, at most 2.0% of Mn, from 8.0 to 16.0% of Ni, from 18.0 to 20.0% of Cr and at most 0.04% of N and containing these ingredients in such a manner that they satisfy a DE value of the following formula to be from 5.0 to 12.0, with a balance of Fe and inevitable impurities:

$$\text{DE value}=\text{Cr}+1.5\text{Si}+0.5\text{Nb}+\text{Mo}—\text{Ni}-0.3\text{Cu}-0.5\text{Mn}-30(\text{C}+\text{N}).$$

2. The exhaust guide member of a nozzle vane-type turbocharger according to claim 1, wherein the exhaust guide member comprises the drive ring, a drive lever, a nozzle ring, and the vane and a shaft of the nozzle vane.

3. An exhaust guide member of a nozzle vane-type turbocharger equipped with a nozzle vane and a drive ring for changing the speed of exhaust gas running through a turbine in accordance with the speed of engine revolution, wherein the member to constitute the nozzle vane and the drive ring and to constitute an exhaust guide for guiding exhaust gas to the turbine is formed of an austenite stainless steel consisting of, in terms of % by mass, at most 0.08% of C, from 2.0 to 4.0% of Si, at most 2.0% of Mn, from 8.0 to 16.0% of Ni, from 18.0 to 20.0% of Cr and at most 0.04% of N, one or two of Nb and Ti in an amount of from 0.05 to 1.0% by mass in total and containing these ingredients in such a manner that they satisfy a DE value of the following formula to be from 5.0 to 12.0, with a balance of Fe and inevitable impurities:

$$\text{DE value}=\text{Cr}+1.5\text{Si}+0.5\text{Nb}+\text{Mo}—\text{Ni}-0.3\text{Cu}-0.5\text{Mn}-30(\text{C}+\text{N}).$$

4. The exhaust guide member of a nozzle vane-type turbocharger according to claim 3, wherein the exhaust guide member comprises the drive ring, a drive lever, a nozzle ring, and the vane and a shaft of the nozzle vane.

5. An exhaust guide member of a nozzle vane-type turbocharger equipped with a nozzle vane and a drive ring for changing the speed of exhaust gas running through a turbine in accordance with the speed of engine revolution, wherein the member to constitute the nozzle vane and the drive ring and to constitute an exhaust guide for guiding exhaust gas to the turbine is formed of an austenite stainless steel consisting of, in terms of % by mass, at most 0.08% of C, from 2.0 to 4.0% of Si, at most 2.0% of Mn, from 8.0 to 16.0% of Ni, from 18.0 to 20.0% of Cr and at most 0.04% of N, one or two of Mo and Cu in an amount of from 0.50 to 5.0% by mass in total and containing these ingredients in such a manner that they satisfy a DE value of the following formula to be from 5.0 to 12.0, with a balance of Fe and inevitable impurities:

$$\text{DE value}=\text{Cr}+1.5\text{Si}+0.5\text{Nb}+\text{Mo}—\text{Ni}-0.3\text{Cu}-0.5\text{Mn}-30(\text{C}+\text{N}).$$

6. The exhaust guide member of a nozzle vane-type turbocharger according to claim 5, wherein the exhaust guide member comprises the drive ring, a drive lever, a nozzle ring, and the vane and a shaft of the nozzle vane.

7. An exhaust guide member of a nozzle vane-type turbocharger equipped with a nozzle vane and a drive ring for changing the speed of exhaust gas running through a turbine in accordance with the speed of engine revolution, wherein the member to constitute the nozzle vane and the drive ring and to constitute an exhaust guide for guiding exhaust gas to the turbine is formed of an austenite stainless steel consisting of, in terms of % by mass, at most 0.08% of C, from 2.0 to 4.0% of Si, at most 2.0% of Mn, from 8.0 to 16.0% of Ni, from 18.0 to 20.0% of Cr and at most 0.04% of N, one or two of REM (rare earth element including Y) and Ca in an amount of from 0.01 to 0.20% by mass in total and containing these ingredients in such a manner that they satisfy a DE value of the following formula to be from 5.0 to 12.0, with a balance of Fe and inevitable impurities:

$$\text{DE value}=\text{Cr}+1.5\text{Si}+0.5\text{Nb}+\text{Mo}—\text{Ni}-0.3\text{Cu}-0.5\text{Mn}-30(\text{C}+\text{N}).$$

8. The exhaust guide member of a nozzle vane-type turbocharger according to claim 7, wherein the exhaust guide member comprises the drive ring, a drive lever, a nozzle ring, and the vane and a shaft of the nozzle vane.

9. An exhaust guide member of a nozzle vane-type turbocharger equipped with a nozzle vane and a drive ring for changing the speed of exhaust gas running through a turbine in accordance with the speed of engine revolution, wherein the member to constitute the nozzle vane and the drive ring and to constitute an exhaust guide for guiding exhaust gas to the turbine is formed of an austenite stainless steel consisting of, in terms of % by mass, at most 0.08% of C, from 2.0 to 4.0% of Si, at most 2.0% of Mn, from 8.0 to 16.0% of Ni, from 18.0 to 20.0% of Cr and at most 0.04% of N, one or two of Nb and Ti in an amount of from 0.05 to 1.0% by mass in total, one or two of Mo and Cu in an amount of from 0.50 to 5.0% by mass in total and containing these ingredients in such a manner that they satisfy a DE value of the following formula to be from 5.0 to 12.0, with a balance of Fe and inevitable impurities:

$$\text{DE value}=\text{Cr}+1.5\text{Si}+0.5\text{Nb}+\text{Mo}—\text{Ni}-0.3\text{Cu}-0.5\text{Mn}-30(\text{C}+\text{N}).$$

10. The exhaust guide member of a nozzle vane-type turbocharger according to claim 9, wherein the exhaust guide member comprises the drive ring, a drive lever, a nozzle ring, and the vane and a shaft of the nozzle vane.

11. An exhaust guide member of a nozzle vane-type turbocharger equipped with a nozzle vane and a drive ring for changing the speed of exhaust gas running through a turbine in accordance with the speed of engine revolution, wherein the member to constitute the nozzle vane and the drive ring and to constitute an exhaust guide for guiding exhaust gas to the turbine is formed of an austenite stainless steel consisting of, in terms of % by mass, at most 0.08% of C, from 2.0 to 4.0% of Si, at most 2.0% of Mn, from 8.0 to 16.0% of Ni, from 18.0 to 20.0% of Cr and at most 0.04% of N, one or two of Nb and Ti in an amount of from 0.05 to 1.0% by mass in total, one or two of REM (rare earth element including Y) and Ca in an amount of from 0.01 to 0.20% by mass in total and containing these ingredients in such a manner that they satisfy a DE value of the following formula to be from 5.0 to 12.0, with a balance of Fe and inevitable impurities:

$$\text{DE value}=Cr+1.5Si+0.5Nb+Mo—Ni-0.3Cu-0.5Mn-30(C+N).$$

12. The exhaust guide member of a nozzle vane-type turbocharger according to claim 11, wherein the exhaust guide member comprises the drive ring, a drive lever, a nozzle ring, and the vane and a shaft of the nozzle vane.

13. An exhaust guide member of a nozzle vane-type turbocharger equipped with a nozzle vane and a drive ring for changing the speed of exhaust gas running through a turbine in accordance with the speed of engine revolution, wherein the member to constitute the nozzle vane and the drive ring and to constitute an exhaust guide for guiding exhaust gas to the turbine is formed of an austenite stainless steel consisting of, in terms of % by mass, at most 0.08% of C, from 2.0 to 4.0% of Si, at most 2.0% of Mn, from 8.0 to 16.0% of Ni, from 18.0 to 20.0% of Cr and at most 0.04% of N, one or two of Mo and Cu in an amount of from 0.50 to 5.0% by mass in total, one or two of REM (rare earth element including Y) and Ca in an amount of from 0.01 to 0.20% by mass in total and containing these ingredients in such a manner that they satisfy a DE value of the following formula to be from 5.0 to 12.0, with a balance of Fe and inevitable impurities:

$$\text{DE value}=Cr+1.5Si+0.5Nb+Mo—Ni-0.3Cu-0.5Mn-30(C+N).$$

14. The exhaust guide member of a nozzle vane-type turbocharger according to claim 13, wherein the exhaust guide member comprises the drive ring, a drive lever, a nozzle ring, and the vane and a shaft of the nozzle vane.

15. An exhaust guide member of a nozzle vane-type turbocharger equipped with a nozzle vane and a drive ring for changing the speed of exhaust gas running through a turbine in accordance with the speed of engine revolution, wherein the member to constitute the nozzle vane and the drive ring and to constitute an exhaust guide for guiding exhaust gas to the turbine is formed of an austenite stainless steel consisting of, in terms of % by mass, at most 0.08% of C, from 2.0 to 4.0% of Si, at most 2.0% of Mn, from 8.0 to 16.0% of Ni, from 18.0 to 20.0% of Cr and at most 0.04% of N, one or two of Nb and Ti in an amount of from 0.05 to 1.0% by mass in total, one or two of Mo and Cu in an amount of from 0.50 to 5.0% by mass in total, one or two of REM (rare earth element including Y) and Ca in an amount of from 0.01 to 0.20% by mass in total, and containing these ingredients in such a manner that they satisfy a DE value of the following formula to be from 5.0 to 12.0, with a balance of Fe and inevitable impurities:

$$\text{DE value}=Cr+1.5Si+0.5Nb+Mo—Ni-0.3Cu-0.5Mn-30(C+N).$$

16. The exhaust guide member of a nozzle vane-type turbocharger according to claim 15, wherein the exhaust guide member comprises the drive ring, a drive lever, a nozzle ring, and the vane and a shaft of the nozzle vane.

* * * * *